US006745906B1

(12) United States Patent
Nagel

(10) Patent No.: US 6,745,906 B1
(45) **Date of Patent: *Jun. 8, 2004**

(54) ADJUSTABLE WIDTH DISPLAY RACK

(75) Inventor: Thomas O. Nagel, Blairstown, NJ (US)

(73) Assignee: Trion Industries, Inc., Wilkes-Barre, PA (US)

( * ) Notice: Subject to any disclaimer, the term of this patent is extended or adjusted under 35 U.S.C. 154(b) by 18 days.

This patent is subject to a terminal disclaimer.

(21) Appl. No.: 10/219,800

(22) Filed: Aug. 16, 2002

Related U.S. Application Data

(63) Continuation-in-part of application No. 10/024,153, filed on Dec. 17, 2001.

(51) Int. Cl.[7] ..... A47F 7/00
(52) U.S. Cl. ..... 211/59.3
(58) Field of Search ..... 211/59.3, 59.2, 211/59.4; 206/556; 221/56, 226, 279; 312/71

(56) References Cited

U.S. PATENT DOCUMENTS

| | | | | |
|---|---|---|---|---|
| 1,703,987 A | | 3/1929 | Butler | |
| 2,079,754 A | | 5/1937 | Waxgiser | |
| 3,308,961 A | | 3/1967 | Chesley | |
| 4,130,203 A | | 12/1978 | Russell, III | |
| 4,899,893 A | | 2/1990 | Robertson | |
| 4,901,869 A | * | 2/1990 | Hawkinson et al. | 211/59.3 |
| 5,366,099 A | | 11/1994 | Schmid | |
| 5,730,320 A | | 3/1998 | David | |
| 5,855,283 A | | 1/1999 | Johnson | |
| 6,082,558 A | * | 7/2000 | Battaglia | 211/59.3 |
| 6,357,606 B1 | | 3/2002 | Henry | |
| 6,464,089 B1 | * | 10/2002 | Rankin, VI | 211/59.3 |

FOREIGN PATENT DOCUMENTS

GB 1299451 12/1972

* cited by examiner

*Primary Examiner*—Alvin Chin-Shue
*Assistant Examiner*—Sarah Purol
(74) *Attorney, Agent, or Firm*—Schweitzer Cornman Gross & Bondell LLP

(57) ABSTRACT

An adjustable width product display system is comprised of a wire rack for supporting display products. At each end of the rack is a molded plastic base member having and upwardly opening recess for the reception of a cross bar element of the product support rack. Each base element is also provided with a pair of downwardly opening grooves of partially circular cross section, for the adjustable reception of transverse base elements of wire side supports. The side supports can be adjustably positioned to accommodate display product of various width. In many cases, a spring driven pusher sled may be provided on the display rack, and the base members are formed with one or more slots for the reception and anchoring of the free end of one or more pusher springs for driving the sled. The plastic base members are designed to accommodate vertical snap-in assembly of the rack and side supports into their respective grooves, to facilitate assembly. The base members are easily modified to include tongue-like extensions, enabling base members to be snapped onto guide strips provided at the front of display shelving, and also to be supported between front and back support rails, for example in a freezer display environment.

12 Claims, 5 Drawing Sheets

FIG. 5
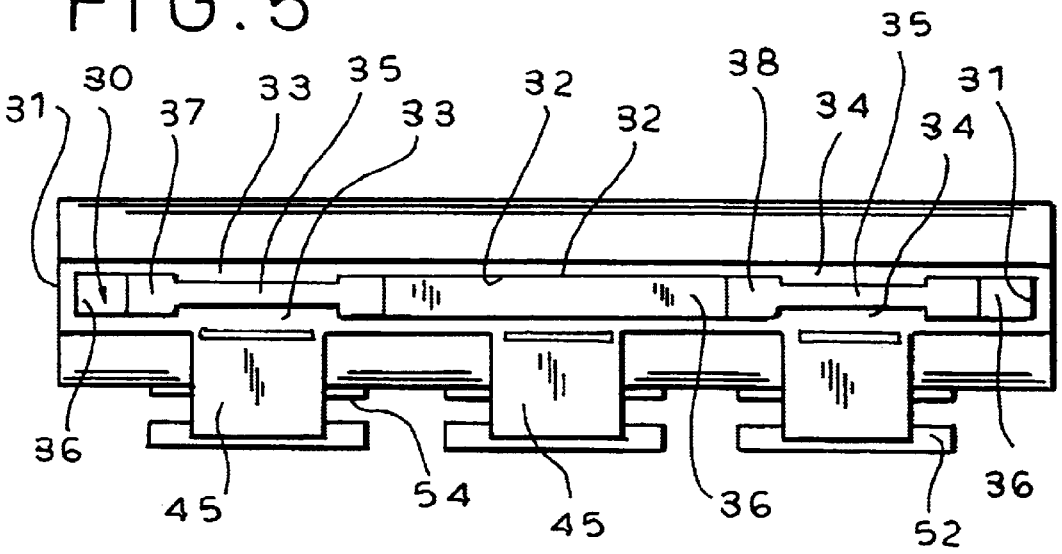
FIG. 6
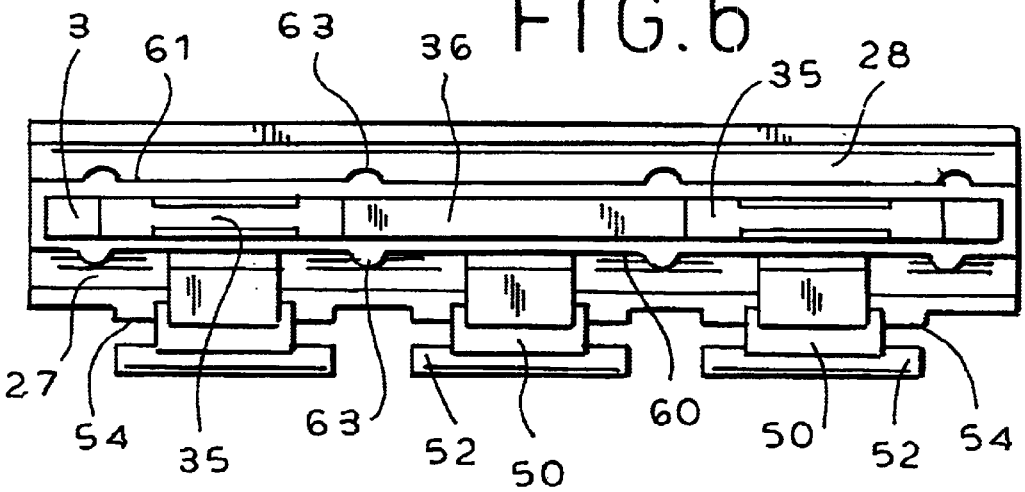
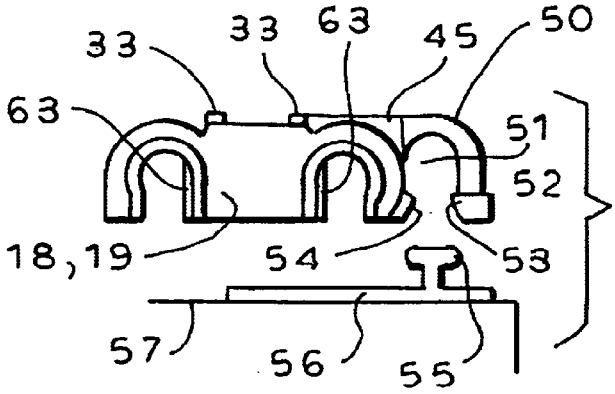
FIG. 7

ADJUSTABLE WIDTH DISPLAY RACK

RELATED APPLICATIONS

This application is a continuation-in-part of co-pending U.S. application Ser. No. 10/024,153, filed Dec. 17, 2001.

BACKGROUND OF THE INVENTION

In my above mentioned co-pending application, there is disclosed an approved form of adjustable width product display assembly, which comprises a display rack, formed of longitudinally and transversely disposed wire elements, mounted at the front and back by special plastic base support bases. The respective front and back bases are provided with a pair of spaced-apart, transversely disposed grooves for receiving transverse bottom portions of adjustable side supports. The side supports are snugly but movably received within the grooves of the plastic base members, to accommodate lateral adjustment, in order to set up the display for reception of packages of different widths. Additionally, by utilizing side supports having transverse elements extending in opposite directions from a single vertical divider element, it is possible to join a series of product display units in side-by-side relation.

The foregoing are features of significant advantage, which are described and claimed in my before mentioned co-pending application. The present invention is directed to specific improvements in the structure of my co-pending application, specifically with respect to the design and functions of the molded plastic base elements.

SUMMARY OF INVENTION

The present invention is directed in part to the design of plastic base member, of the type described in my co-pending application, which has a lower effective profile and thus enables the display rack to be supported at a lower level with respect to a shelf or other surface on which the assembly is positioned. This is accomplished by, among other things, positioning recesses for the reception of the adjustable side elements and for reception of transverse elements of the display rack with sufficient spacing to accommodate at least some vertical overlap in the levels of their respective cross sections, such that lower portions of the transverse elements of the rack can lie below upper portions of transverse elements of the side supports. The display rack thus can be supported over the surface on which it is placed with a minimum clearance space, in order to optimize utilization of the available space.

In accordance with one aspect of the invention, the respective recesses for receiving the transverse portions of the side supports are open along their entire length, along the bottom, to form lateral entrance openings which are only slightly narrower in width than the diameter of the wire elements to be received therein. This enables the transverse elements of the side supports to be installed by a lateral snap-in action, rather than requiring them to be inserted lengthwise into the recesses. This simplifies and expedites the assembly operation. The upwardly opening recess, for receiving a cross bar of the display rack, likewise is designed to accommodate and facilitate a lateral (i.e., downward) snap-in positioning of the cross bar within the recess.

Where the display assembly is intended to be used in connection with a spring-actuated product pusher, the base molding of the invention advantageously is provided with one or more anchor slots for the reception and anchoring engagement of the forward end of a pusher spring.

In certain advantageous forms of the invention, hook-like guide and/or support elements are provided along one side. For certain specialty applications, such as freezer displays, these hook-like elements provide a convenient and effective means for supporting the display rack at its opposite ends by means of spaced-apart support rods or the like, without any shelf or rack structure underneath the display. For more conventional shelf displays, the hook-like elements can be used to great advantage in combination with a guide track element mounted along a front and/or back edge of the display shelf. The design of the hook-like elements is such as to enable them to be installed downwardly over the top of a guide track, with a snap-in connection, after which the display rack may be laterally moved and positioned along the guide track. The use of such guide tracks provides a neat-appearing display, allowing the individual display racks to be reliably retained in their initially adjusted positions.

For a more complete understanding of the above and other features and advantages of the invention, reference should be made to the following detailed description of preferred embodiments, and to the accompanying drawings.

DESCRIPTION OF THE DRAWINGS

FIGS. 5 and 6 are top and bottom plan views respectively of a plastic base member according to the invention.

FIG. 7 is an exploded side elevational view showing an end view of the plastic base and a guide track arranged to be coupled therewith.

DESCRIPTION OF PREFERRED EMBODIMENTS

Figure 1:
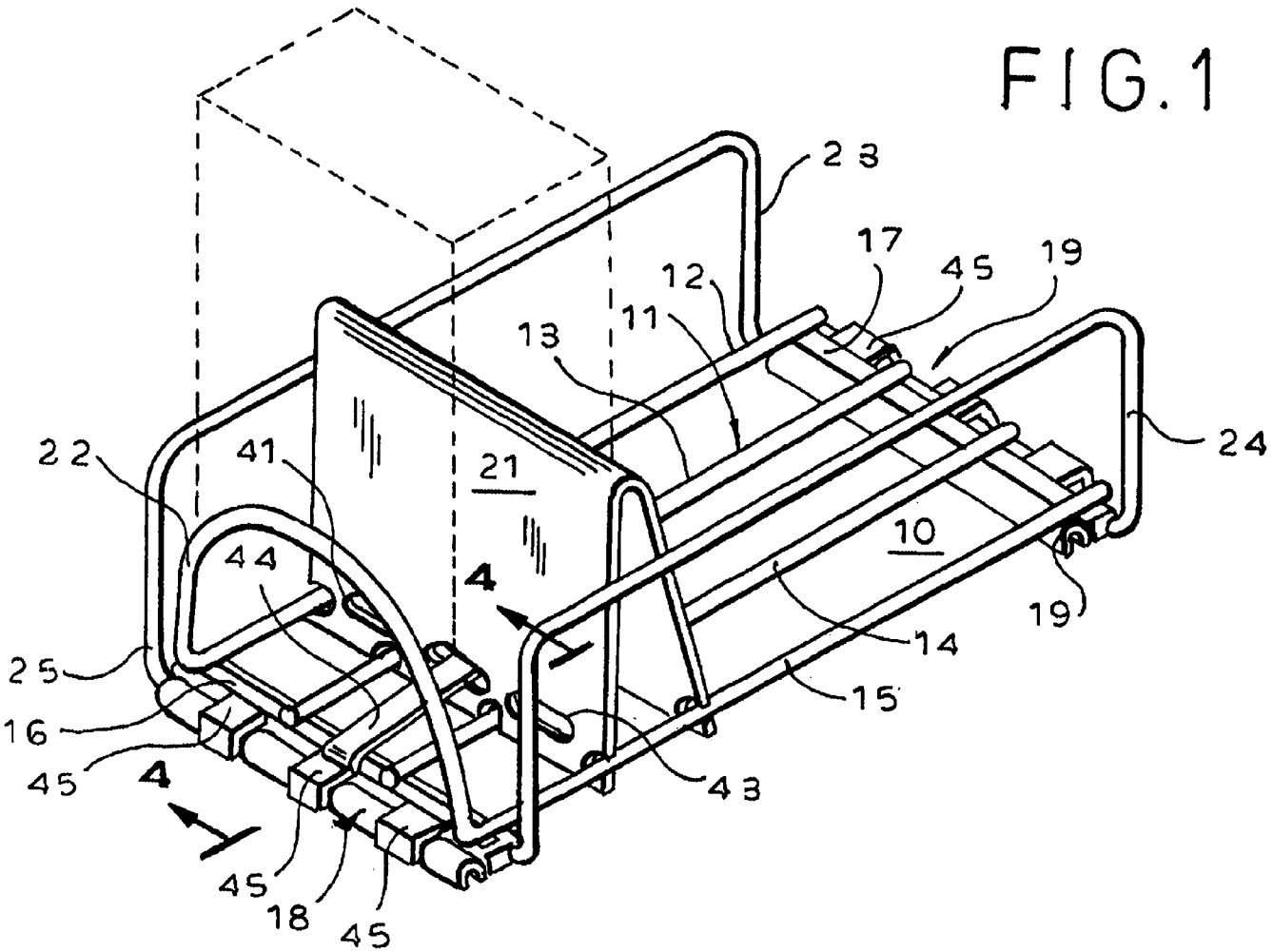
FIG. 1 is a perspective view of a typical form of product display rack incorporating molded plastic base supports according to the invention.

Referring now to the drawings, and initially to FIG. 1 thereof, the reference numeral 10 designates generally a product display assembly which, in its illustrated form, comprises a support rack 11 comprised of a plurality of longitudinally disposed wire supports 12–15 and a pair of cross bar wires 16, 17, one at each end. The cross bar elements 16, 17 are located underneath the longitudinal wires and are welded thereto to form a rigid rack structure. The respective cross bar elements 16, 17 are mounted in front and back molded base members 18, 19, to be described in greater detail hereinafter. Typically, but not necessarily, the base members 18, 19 are supported on a shelf 20 (FIG. 3) or other support surface. The wire elements 12–15 of the rack are spaced a short distance above the support surface 20.

In many cases, the display rack will incorporate a pusher sled 21, which is supported by the outboard longitudinal wires 12, 15 and has portions projecting a short distance below those wire elements such that at least a small clearance space is needed between the wires 12, 15 and the support surface 20.

A particularly advantageous form of product pusher arrangement forms the subject matter of co-pending application Ser. No. 10/232,509 of Thomas O. Nagel, filed Aug. 30, 2002.

In the illustrated form of display assembly, the outside wire supports 12, 15 are joined at the front by means of an upwardly extending arcuate portion 22 which forms of a front stop, cooperating with the pusher sled 21 to limit forward movement of the display products.

Figure 2:
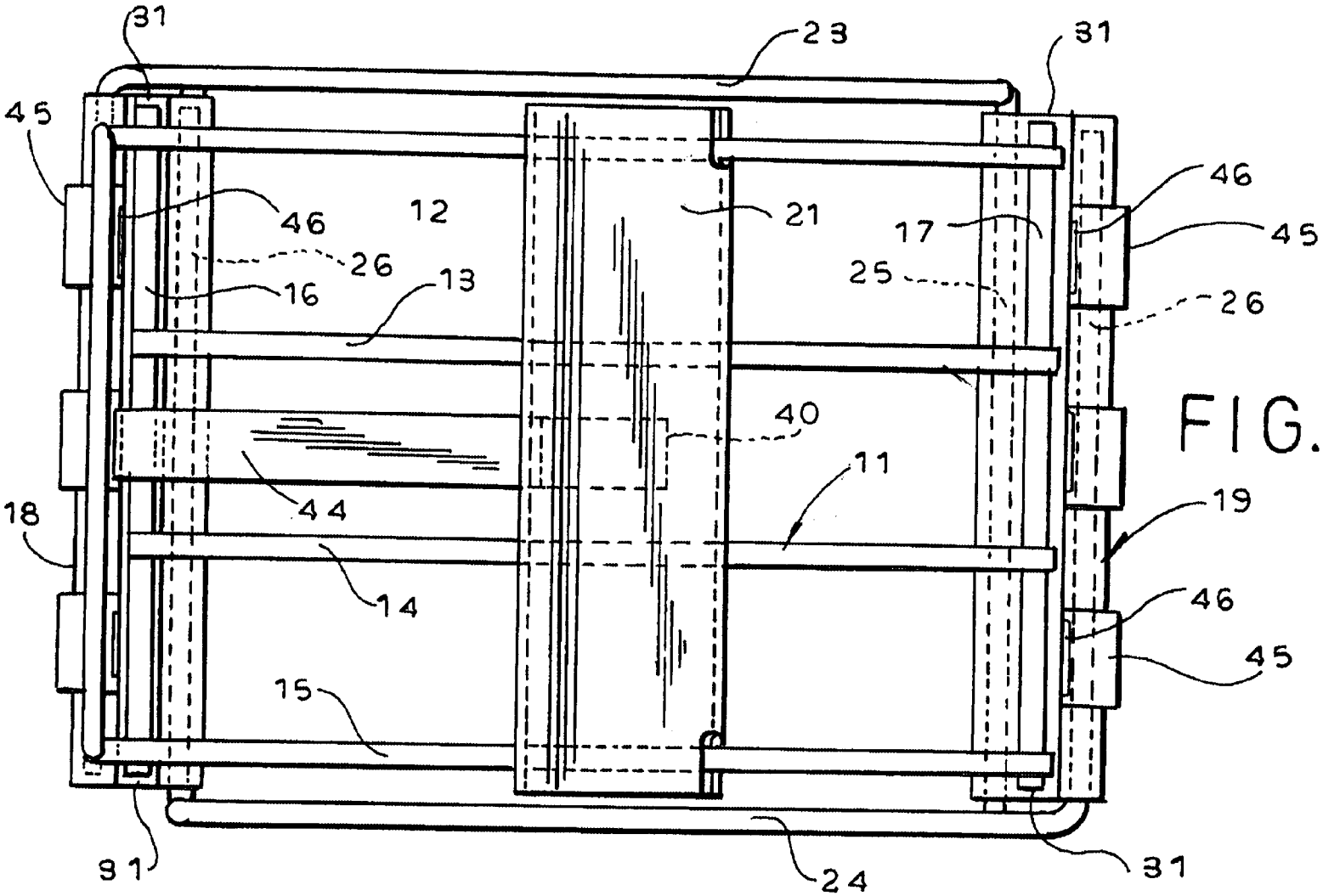
FIG. 2 is a top plan view of the display assembly of FIG. 1.

Pursuant to one aspect of the invention, side supports 23, 24 are provided at opposite sides of the display assembly. Each of the side supports include transversely extending bottom portions 25, 26 which are received in downwardly opening transverse grooves 27, 28 respectively in the front base member 18, and in grooves 28, 27 respectively in the rear base member 19. The length of the transverse wire portions 25, 26 preferably is substantially equal to the overall length of the base members 18, 19 such that, when the side supports 23, 24 are in their narrowest adjusted positions, the transverse portions extend substantially from side to the other of the base members. As is apparent in FIG. 2, the respective transverse portions 25, 26 are offset from each other, in parallel relation, so as to accommodate a full length of overlap when the side supports are adjusted to the narrow position. For wider products, one or both of the side supports can be moved laterally outward a substantial distance, as long as there is at least some fraction of the transverse portion 25, 26 remaining within the grooves 27, 28, sufficient to provide supporting engagement.

As described in my co-pending application Ser. No. 10/024,153, certain of the side supports (not shown here) may be provided with an inverted "T" configuration, with transverse portions arranged to engage with product displays on both sides and a divider element between them, serving the dual purpose of providing a side support for two displays, and also of locking the two displays together in predetermined alignment and spacing. Indeed, a whole series of display assemblies may be joined together in this manner.

In the form of the invention illustrated in FIGS. 1–4, the front and back base members 18, 19 can be of identical construction and are preferably, although not necessarily, oriented in opposite directions at each end of the assembly. To particular advantage, the base members are of injection molded construction, formed of an engineering plastic material such as Celcon®, and acetal copolymer, marketed by Celanese Corporation of America, New York, N.Y.

Preferably, the base members 18, 19 are of a length slightly greater than the length of the cross bar elements 16, 17, such that end portions of the base members project slightly beyond the ends of the cross bar elements. An upwardly opening recess 30 is provided in each base member, extending across most of its width, except for portions 31 at each end which form confining end walls. The principal side walls 32 of the cross bar recess 30 (see FIG. 5) preferably are of a width approximately equal to the diameter of the cross bars 16, 17, such that the recess snugly but freely receives the cross bars 16, 17 over most of its length. The depth of the recess preferably is slightly less than the diameter of the cross bar elements. The cross bar elements are thus mostly received within the transverse recesses 30, as reflected particularly in FIG. 4. The principal side walls 32 of the cross bar recess 30 (see FIG. 5) preferably are of a width approximately equal to the diameter of the cross bars 16, 17, such that the basic dimensions of the recess 30 are such that it snugly but freely receives the cross bars 16, 17 over most of its length.

In order to grip and retain the cross bars 16, 17, the recesses 30 are provided with spaced apart pairs of retention tabs 33, 34 (FIG. 5) extending slightly upward from the upper edges of the recesses 30 and projecting slightly inward to form a gap 35 of a width slightly less than the diameter of the cross bars 16, 17. The arrangement is such that the cross bars 16, 17 may be pressed downwardly on the retention tabs 33, 34 to cause the tabs to elastically separate and admit the cross bars into the recesses 30. As is evident in FIG. 4, the retention tabs 33, 34 engage the cross bars 16, 17 on locations above the maximum diameter thereof, to elastically retain the cross bars snugly within the recesses 30.

To facilitate forming of the retention tabs 33, 34 in the injection molding procedure, the bottom wall 36 of the recess 30 is interrupted in areas below the retention tabs 33, 34, by openings 37, 38 which extend through to the bottom of the base member. This enables mold parts (not shown) used in the injection molding process to be projected upward through the openings 37, 38 to form the inside portions of the entrance-restricting retention tabs 33, 34. Portions of the bottom wall 36 of the recess 30 located between the openings 37, 38, and beyond the opposite ends of the openings, provide full support for the cross bar elements 16, 17. The described arrangement enables easy, vertically downward snap-in assembly of the cross bars 16, 17 into the recesses 30 to secure the rack firmly to the respective front and back base members.

Figure 4:
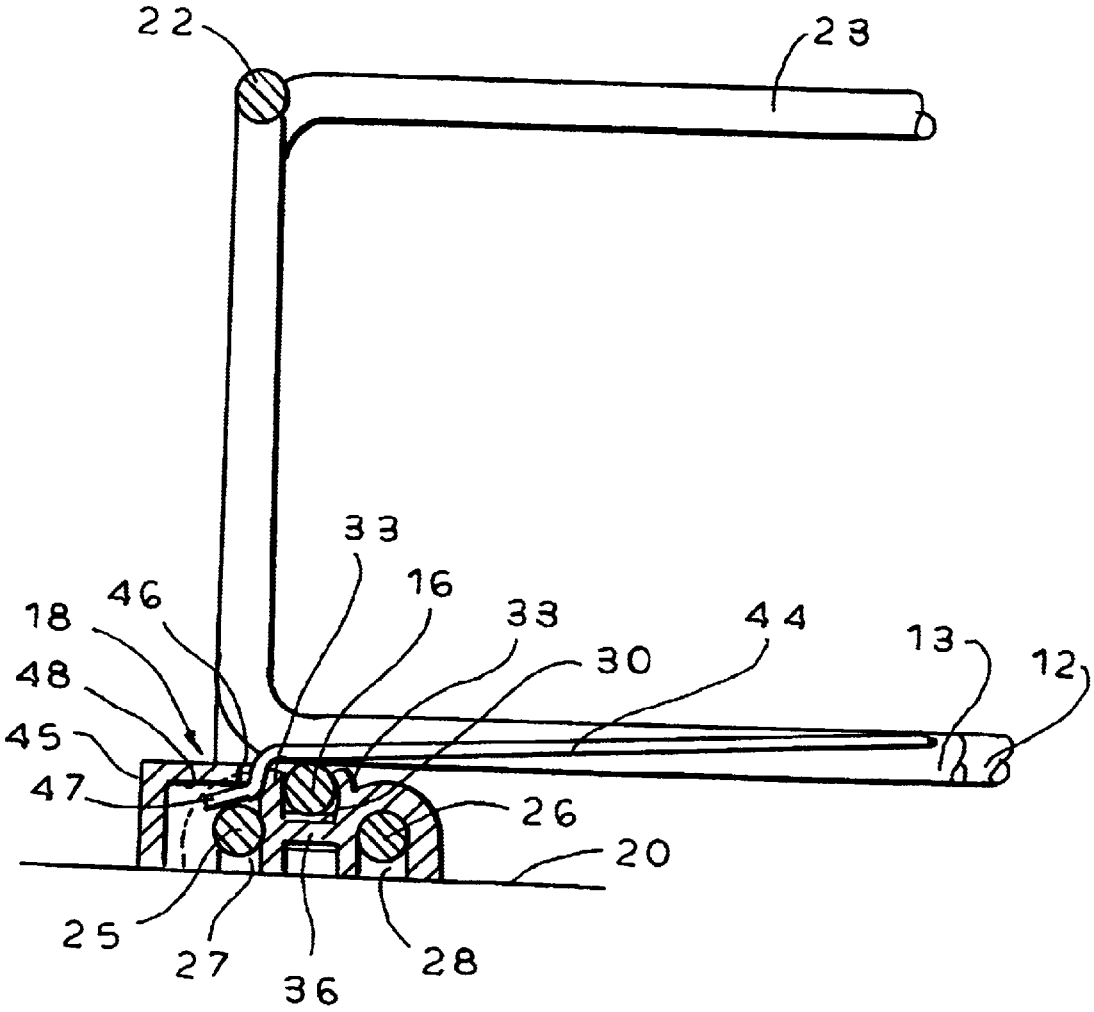
FIG. 4 is an enlarged, fragmentary cross sectional view as taken generally on line 4—4 of FIG. 1.

As shown in FIG. 4, the spacing and location of the downwardly transverse grooves 27, 28 enables the upwardly opening cross bar recess 30 to be nested between them preferably with some vertical overlap between the upper portions of the grooves 27, 28 and the lower portion of the recess 30. The arrangement is such that the base has a relatively low profile and enables the rack 11 to be positioned with a relatively minimum spacing above the support surface 20. In this respect, it will be understood that at least some vertical spacing of the rack above the support surface 20 is necessary and desirable to accommodate the pusher sled 21.

Figure 3:
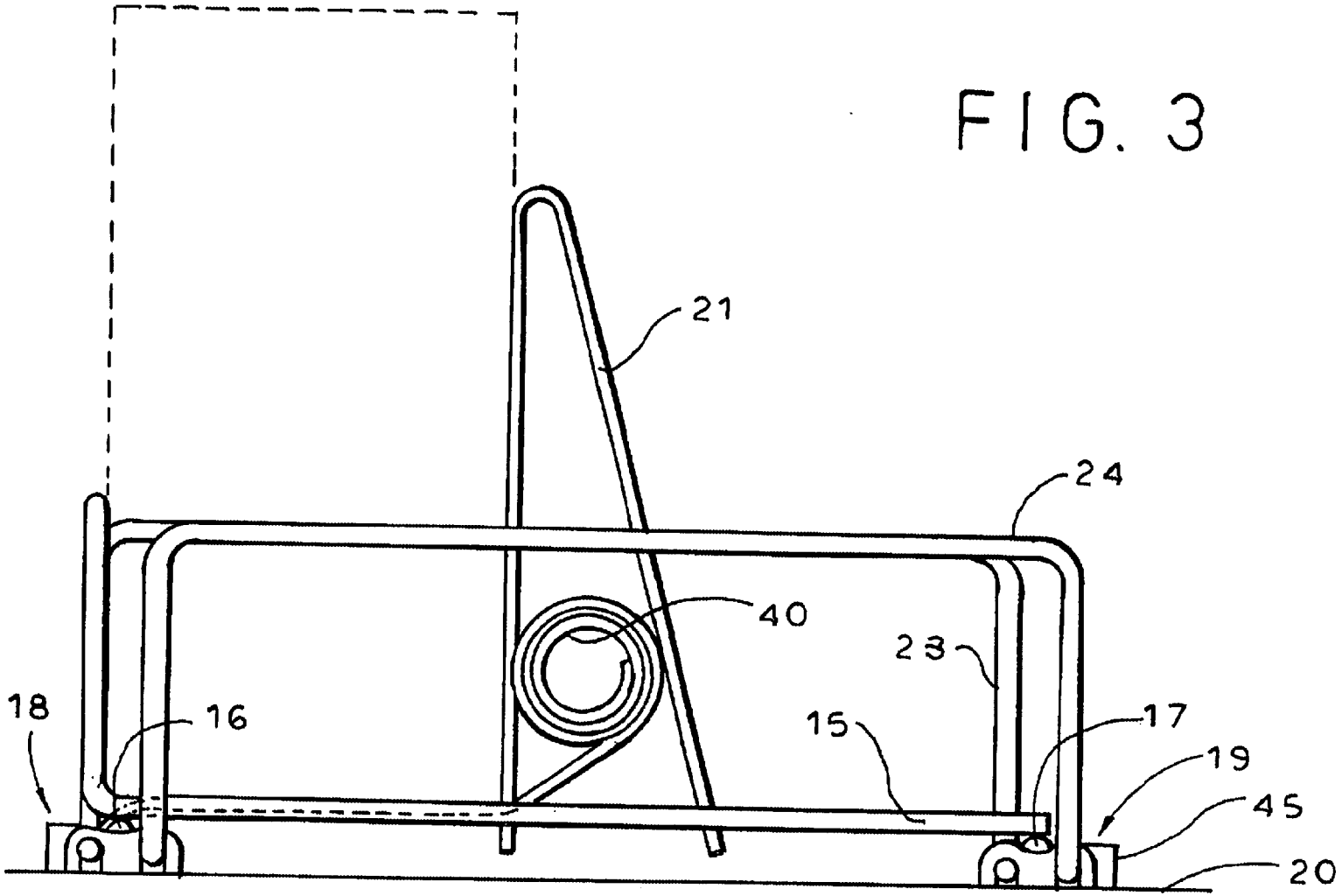
FIG. 3 is a side elevational view of the display assembly of FIG. 1.

In the display device illustrated herein, the pusher sled 21 is designed to accommodate from one to three coiled strip pusher springs 40, of the type illustrated in FIG. 3. These springs, per se, are well known and widely used. Nevertheless, the illustrated form of sled 21 and spring 40 has significant advantages as set forth more particularly in the before mentioned co-pending application Ser. No. 10/232,509 of Thomas O. Nagel, filed Aug. 30, 2002. The sled has three openings 41–43 in the front wall thereof, through which forwardly extending portions 44 of the spring (or springs) 40 can extend. In a typical installation, a single spring is usually sufficient. However, for special cases, where the displayed merchandise is quite heavy, it may be preferable to employ two springs, with portions projecting through the outboard openings 41, 43. In some cases, three springs may be employed, depending upon the strength of the springs and the weight of the merchandise, as will be understood.

Pursuant to the invention, the base members 18, 19 are formed with a plurality of extension bases 45, preferably in the form of hollow enclosures, spaced along the outboard side of the base members (i.e., the front side of the front base member 18 and the back side of the back base member 19). The extension bases 45 are aligned with the spring openings 41–43 of the pusher sled, and each is provided at its inboard side with a vertical slot 46 (see FIG. 4) for the reception of an L-shaped end section 47 of the spring 40. An upper wall 48 of the extension base is located slightly above the upper extremity of the outboard groove 27, so as to provide clearance above the transverse wire 25, for receiving the end portion 47 of the spring. The clearance space above the transverse wire element 25 can be relatively small, as long as the transverse wire 25 can move beneath the spring to accommodate lateral adjustment of the wire 25. Typically, it is necessary, or at least very desirable, to install the spring end 47 before the transverse wire section 25 is positioned below the slot 46, to facilitate insertion of the spring end into the slot. Once the spring end is inserted, and the spring is properly anchored to the base member, the transverse wire portion 25 can be positioned underneath the spring end 47, and can be laterally adjusted as necessary without interfering with the spring end.

As will be evident in FIG. 4, the forward portion 44 of the spring, after exiting from the front opening 42 in the pusher sled, passes over the top of the cross bar 16 and then through the vertical slot 46, which lies on the outboard side of the cross bar.

The back base member 19 is formed with similar extension bases 45, and each of those is typically formed with an anchor slot 46, the same as for the front base member 18. Although the anchor slots 46 for the back base member 19 perform no function, the manufacturing process is simplified by making identical parts for the front and back, as will be understood.

The form of the invention shown in FIGS. 1–4 is intended for applications in which the display device is simply placed upon a shelf or other display surface. In many cases, however, it is desirable to provide means for aligning one or more display units in orderly fashion on a shelf. In other cases, it is desirable to suspend the display unit between spaced apart wires or rails arranged to support the display unit only at its front and back ends. The latter instance is desirable in, for example, a freezer display, in which it is desirable to provide for open circulation of air in and around the articles of merchandise supported on the display unit. For such applications, a modified form of base element is provided, as shown generally in FIGS. 5–7.

In the embodiment of FIGS. 5–7, the extension bases 45 mount tongue-like extensions 50 which project outward and downward, forming downwardly opening recesses 51 of inverted U-shape configuration. At the lower end of each of the tongue-like extensions is a horizontal guide bar 52, which preferably is of somewhat greater length than the width of the extension 50. A portion 53 of the guide bar 52 extends into the U-shape recess 51 and is opposed by a rib 54 on the opposite side of the recess, which also projects somewhat into the recess, to form a restricted entrance. The lower surfaces of the guide bar 53 and rib 54 are outwardly divergent to facilitate snap-in attachment of the base member to a T-shaped guide rail 55 projecting upward from a guide strip 56 which is fastened by adhesive or other means to a display surface 57, as shown in FIG. 7. When a base member 18, 19 is snapped over the guide rail 55, it becomes locked thereto, while being slideable lengthwise along the guide rail. Typically, the guide strip 56 is mounted near the front of a display shelf 57 such that one or more display assemblies, mounted on the bases 18, 19, can be positioned in accurate front-to-back alignment by the guide strip 56 and guide rail 55. If desired, guide strips 56 may be provided at both the front and back of the display assembly, although frequently a single guide strip along the front is adequate for the purpose.

For freezer applications, spaced apart wires or rails (not shown) are provided in positions to be received in the downwardly opening U-shaped recesses 51 at the front and the back of the display assembly. Typically, the thus mounted display assembly is movable laterally along the wire or rail supports to provide access to areas below. For freezer applications, the use of the Celcon copolymer material is particularly advantageous, in that it does not become brittle and subject to breakage when maintained under freezer temperatures.

In a preferred embodiment of the invention, the downwardly opening grooves 27, 28 (FIG. 6) are dimensioned to have only a slightly restricted entrance opening along the bottom side, to accommodate relatively easy lateral snap-in assembly of the transverse wire portions 25, 26 there into or, alternatively, the axial insertion of the wires from the end. To provide an appropriate degree of frictional gripping of the wire elements 25, 26, it is advantageous to provide the inside walls 60, 61 respectively of the grooves 27, 28 with a few widely spaced vertical ribs 63 which project a short distance into the grooves 27, 28 such that the cross section thereof is constricted in a few locations, sufficient to grip the transverse wire elements 25, 26 snugly enough to maintain them in assembled relation to the base members 18, 19, and also to retain them in adjusted lateral positions. The outer walls of the grooves 27, 28 preferably are somewhat more flexible than the inner walls and can flex as necessary to accommodate vertical snap-in assembly of the wire element 25, 26 into the grooves.

The product display system of the invention is particularly advantageous in that the design and construction of the base members 18, 19 enables quick assembly of a product display rack with width adjustable side guides and/or a product pusher sled. The base members attach front and back to cross bars of a wire display rack, by easy vertical snap-in assembly. Likewise, wire side support elements may be easily inserted into downwardly opening grooves in the base member, either by vertical snap-in assembly or by axial insertion, in either case providing for a wide range of lateral adjustment to accommodate various product sizes.

The design of the base members is such that they easily accommodate adaptation to provide for engagement with the guide strips mounted on a shelf or other display surface and/or spaced apart support wires or rails, as for example are frequently employed in freezer displays.

The design of the base members is such that the parts may be easily produced by injection molding procedures, and the functional features are designed to accommodate efficient production in this manner.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. An adjustable width product display system, which comprises one or more product display units, each comprising (a) a product support structure comprising a generally rectangular wire frame, including spaced apart first wire elements extending from front to back, and a pair of transversely disposed wire cross bar elements connecting front and back ends of said first wire elements, (b) spaced apart front and back base members each having elements on upper portions thereof for engaging and supporting said product support structure, (c) said product display unit having a front-to-back axis, and said front and back base members extending generally perpendicular to said axis, (d) said base members being formed of molded plastic material, and being formed with first and second overlapping, adjacent transverse recesses, (e) first and second side supports formed of wire and disposed on opposite sides of said base members, (f) each of said side supports including front and back, transversely disposed mounting elements, formed of wire and received for transverse slideable adjustment within the transverse recesses of said front and back base members.

2. A product display system according to claim 1, wherein (a) each said base member has an upwardly opening, transversely extending groove therein for the reception of one of said wire cross bar elements, for fixing of said base members to said wire frame.

3. A product display system according to claim 2, wherein (a) end stops are provided at opposite ends of said upwardly opening grooves to confine and position said cross bar elements.

4. A product display system according to claim 2, wherein (a) said upwardly opening grooves are of a width to freely receive said cross bar elements, and (b) said upwardly opening grooves are provided with retaining tabs for grippingly engaging opposite sides of said wire cross bar elements while accommodating vertical snap-in engagement of said transverse wire elements into said upwardly opening grooves.

5. A product display system according to claim 4, wherein (a) said upwardly opening grooves are positioned between said first and second transverse recesses.

6. A product display system according to claim 5, wherein (a) said first and second transverse recesses are open along their bottoms to accommodate vertical snap-in engagement of said transversely disposed mounting elements.

7. A product display system according to claim 4, wherein (a) said base member is formed with through openings extending from a bottom surface thereof to said retaining tabs, and (b) said through openings extend laterally at least coextensively with said retaining tabs.

8. A product display system according to claim 1, wherein (a) said first and second transverse recesses are open along bottoms thereof to accommodate vertical snap-in engagement of said transversely disposed mounting elements, (b) the bottom openings of said transverse recesses are of a width to easily receive said mounting elements, and (c) a plurality of transversely spaced vertical ribs are formed in each of said transverse recesses to more tightly grip said mounting elements.

9. A product display system according to claim 8, wherein (a) said transverse recesses have inner and outer wall portions, (b) said outer wall portions being more flexible than said inner wall portions, and (c) said vertical ribs being formed on said inner wall portions.

10. A product display system according to claim 1, wherein (a) said base members are formed with a plurality of tongue-like extensions along one side thereof, (b) each of said extensions projects outward from an upper portion of said base member and includes a downwardly extending portion, and (c) said downwardly extending portion forms, with other portions of said base member, a downwardly opening recess for the reception of a guide or support member.

11. A product display system according to claim 10, wherein (a) said product display system includes a support surface and a guide rail fixed to said support surface, and (b) said downwardly opening recess receives and engages said guide rail for slideable positioning of said base member and product support structure on said support surface.

12. A product display system according to claim 10, wherein (a) the downwardly extending portions of said tongue-like extensions mount laterally extending guide elements of greater width than said tongue-like extensions, (b) said guide elements having slideable engagement with said guide rail.

* * * * *

Disclaimer 6,745,906 B1 — Thomas O. Nagel, Blairstown, NJ (US), ADJUSTABLE WIDTH DISPLAY RACK. Patent dated Jun. 8, 2004. Disclaimer filed May 27, 2004, by the assignee, Trion Industries, INC.

The term of this patent shall not extend beyond the expiration date of Pat. No. 6,719,152.

*(Official Gazette, October 5, 2004)*